US009084520B2

(12) United States Patent
Assmann et al.

(10) Patent No.: US 9,084,520 B2
(45) Date of Patent: Jul. 21, 2015

(54) VACUUM CLEANER TURBO-BRUSH

(75) Inventors: Walter Assmann, Bielefeld (DE); Volker Marks, Bielefeld (DE); Cornelius Wolf, Bielefeld (DE)

(73) Assignee: MIELE & CIE, KG, Guetersloh (DE)

( * ) Notice: Subject to any disclaimer, the term of this patent is extended or adjusted under 35 U.S.C. 154(b) by 739 days.

(21) Appl. No.: 13/448,548

(22) Filed: Apr. 17, 2012

(65) Prior Publication Data

US 2012/0260457 A1 Oct. 18, 2012

(30) Foreign Application Priority Data

Apr. 18, 2011 (EP) ..... 11 401 062

(51) Int. Cl.
*A47L 5/00* (2006.01)
*A47L 9/04* (2006.01)

(52) U.S. Cl.
CPC ..... *A47L 9/0416* (2013.01)

(58) Field of Classification Search
CPC ..... A47L 9/0416
USPC ..... 15/375, 387, 421
IPC ..... A47L 5/00
See application file for complete search history.

(56) References Cited

U.S. PATENT DOCUMENTS

| | | | | |
|---|---|---|---|---|
| 2,078,634 | A * | 4/1937 | Karlstrom | 15/385 |
| 2,178,003 | A * | 10/1939 | Smellie | 15/375 |
| 5,802,666 | A | 9/1998 | Jung | |
| 2005/0251953 | A1 | 11/2005 | Hackwell et al. | |

FOREIGN PATENT DOCUMENTS

| | | | |
|---|---|---|---|
| DE | 3414862 | A1 | 11/1985 |
| GB | 2320421 | A | 6/1998 |
| GB | 2393383 | A | 3/2004 |
| JP | 54042855 | A | 4/1979 |
| WO | WO 2006080383 | A1 | 8/2006 |

OTHER PUBLICATIONS

European Patent Office, Extended European Search Report in European Patent Application No. 11401062.2 (Sep. 9, 2011).

* cited by examiner

*Primary Examiner* — David Redding
(74) *Attorney, Agent, or Firm* — Leydig, Voit & Mayer, Ltd.

(57) ABSTRACT

A vacuum cleaner turbo-brush includes an axial-inflow impulse turbine. The turbine includes a turbine shaft non-rotatably combined with an impeller that includes aerodynamically shaped, stud-like projections uniformly distributed along a circumferential line of the impeller. The aerodynamic shape has a cross-sectional area that is parabolically bound on both sides. The turbine also includes a guide stage having guide surfaces, each of which has a cross section including, in a direction of incident flow, a circular arc followed by a straight section. A bearing housing surrounds the turbine shaft and forms at least one of a transition and the guide stage in a region of the impeller, and the bearing housing, in a region of the turbine shaft, forming a casing for the turbine shaft and including bearing elements that support the turbine shaft.

14 Claims, 6 Drawing Sheets

10

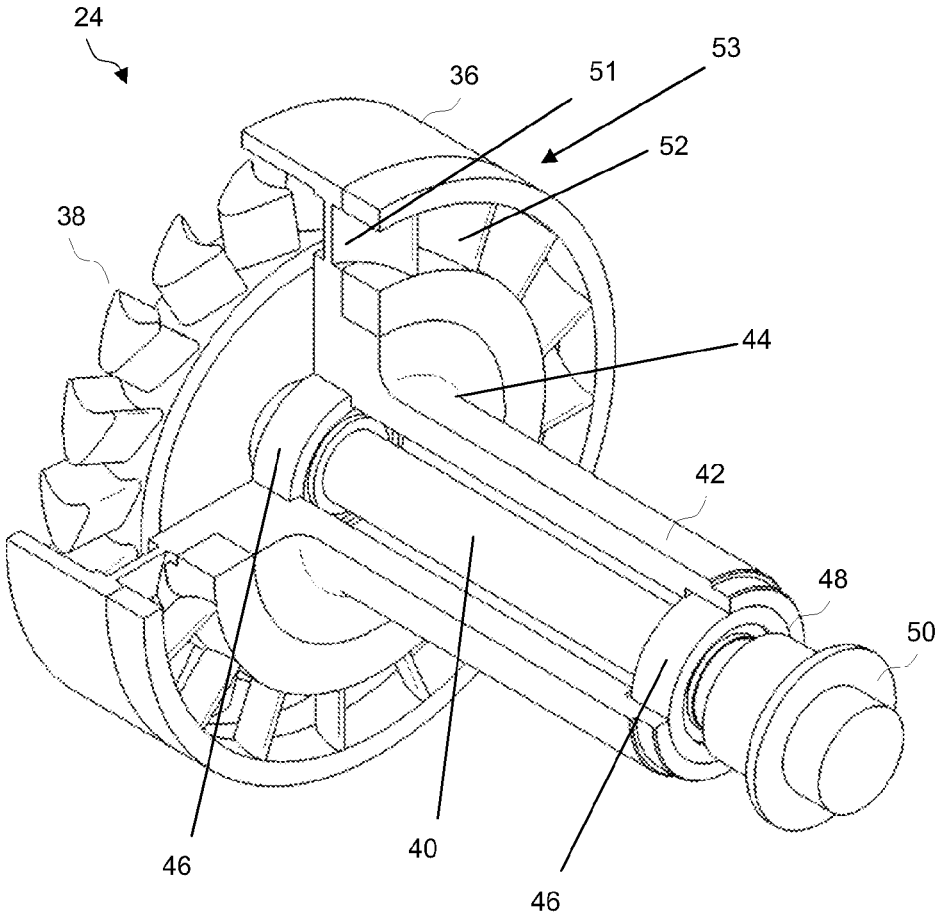
Fig. 2
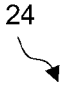

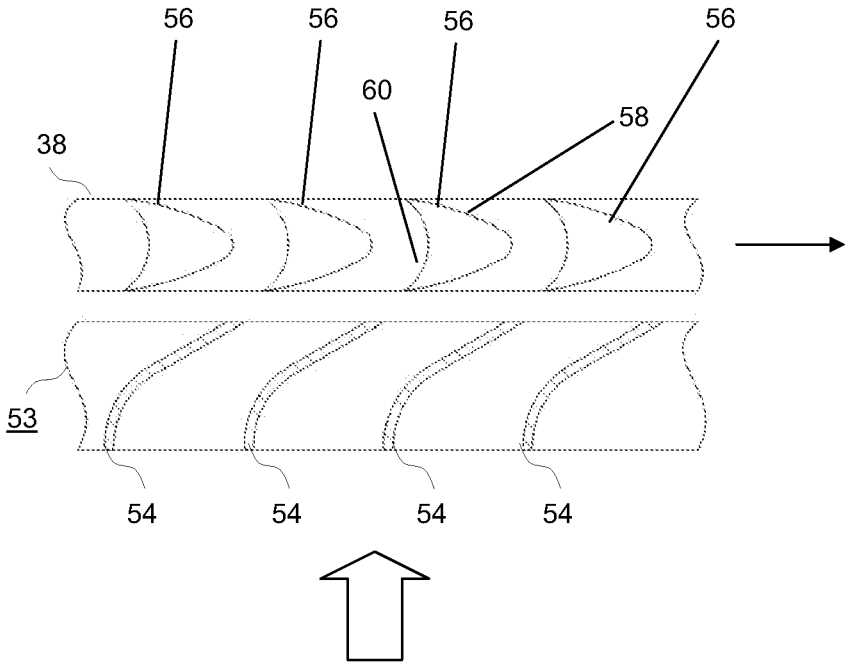
Fig. 4
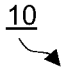

62

VACUUM CLEANER TURBO-BRUSH

CROSS REFERENCE TO RELATED APPLICATIONS

This application claims priority to European Patent Application No. 11 401 062.2, filed Apr. 18, 2011, which is hereby incorporated by reference herein in its entirety.

FIELD

The present invention relates to a so-called "vacuum cleaner turbo-brush"; i.e., a vacuum cleaner suction head having a turbine-driven brush or bristle roller for a vacuum cleaner, including a canister vacuum cleaner or an upright vacuum cleaner.

BACKGROUND

Turbo-brushes are used, for example, for cleaning carpeted floors or the like, or for vacuuming carpets which have dirt ground into the carpet pile. German Patent DE 34 14 862 C2 describes a vacuum cleaner suction head having a wand connector, a glide sole, and a rotating brush roller. The brush roller is driven by a radial-inflow turbine. A relatively narrow, movable guide nozzle is disposed downstream of the turbine, said guide nozzle causing the suction air or primary air stream passing through the suction head to be concentrated onto the impeller or turbine wheel. The turbine is what is known as a drag-type device. Since the turbine is disposed in the primary air stream; i.e., operated with dirty suction air, it may happen that picked-up dirt particles clog the suction channel containing the guide nozzle or block the impeller. Such dirt accumulations must then be removed by the user of the turbo-brush. This is basically easy to do, but is nevertheless perceived as disagreeable.

Besides turbo-brushes having suction-air driven turbines, other turbo-brushes include reaction turbines which are disposed in a secondary air stream and driven by clean ambient air.

The main disadvantage of concepts using a turbine disposed in the primary air stream is the reduced efficiency, which is due to the fact that the dirt particles to be expected in the air stream make it impossible to work with the otherwise possible gap dimensions between the impeller and the turbine housing. Moreover, the blade spacing must be relatively large to allow dirt particles to pass through the impeller. Known reaction turbines which are operated with clean ambient air in the secondary air stream require the gap dimensions between the impeller and the turbine housing to be kept to a minimum in order to achieve sufficient efficiency. In addition, since the impeller speed is significantly (typically four times) higher compared to a drag-type device, a more complex conversion transmission is required to transmit the driving power to the brush roller.

GB 2 393 383 A describes embodiments of turbines including a radial-inflow turbine as well as a Pelton wheel.

SUMMARY

In an embodiment, the present invention provides a vacuum cleaner turbo-brush including an axial-inflow impulse turbine disposed in a secondary airstream area of the vacuum cleaner. The turbine includes a turbine shaft non-rotatably combined with an impeller that includes aerodynamically shaped, stud-like projections uniformly distributed along a circumferential line of the impeller. The aerodynamic shape has a cross-sectional area that is parabolically bound on both sides. The turbine also includes a guide stage having guide surfaces, each of which has a cross section including, in a direction of incident flow, a circular arc followed by a straight section. A bearing housing surrounds the turbine shaft and forms at least one of a transition and the guide stage in a region of the impeller, and the bearing housing, in a region of the turbine shaft, forming a casing for the turbine shaft and including bearing elements that support the turbine shaft.

BRIEF DESCRIPTION OF THE DRAWINGS

Exemplary embodiments of the present invention are described in more detail below with reference to the drawings, in which:

FIG. 2 is a perspective, partially cut-away view of a turbine of the vacuum cleaner turbo-brush;

FIG. 4 is a view showing details of the turbine in a cross section through its impeller and an upstream guide stage;

DETAILED DESCRIPTION

Figure 1:
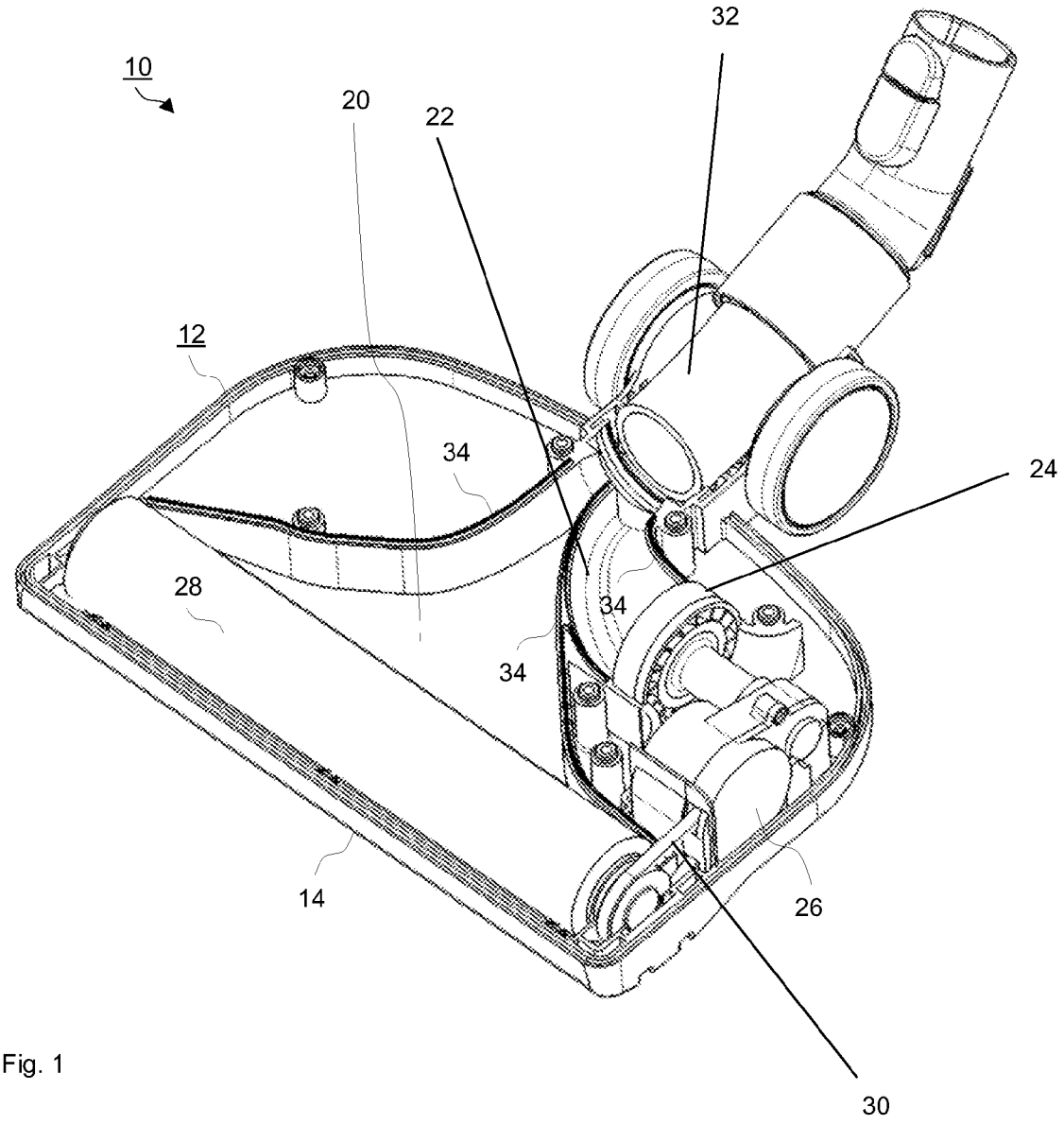
FIG. 1 is a view of a vacuum cleaner turbo-brush with the housing open.

In an embodiment, the present invention provides a turbo-brush, in particular one that improves the efficiency of the turbine used therein.

In an embodiment of the vacuum cleaner turbo-brush, the turbine is disposed in the secondary air stream and is designed as an impulse turbine.

The positioning of the turbine in the secondary air channel, and thus, in the secondary air stream occurring during operation, prevents entry of dirt, which is unavoidable if the turbine is disposed in the primary air stream. If the turbine is embodied as an impulse turbine, the static pressure of the ambient air, which is used as the working medium, is the same upstream and downstream of the impeller. Thus, only the converted kinetic energy, the dynamic pressure, of the drawn-in ambient air is used for driving the impeller. An impulse turbine has a degree of reaction equal to zero, while reaction turbines have a degree of reaction greater than zero.

Because of the zero pressure differential between the upstream and downstream sides of the impeller, an impulse turbine has the advantage of allowing for less accurate sealing between the impeller blades and the turbine housing. This simplifies manufacture and allows the individual components to be manufactured with less stringent tolerances. Moreover, for the same power output, a speed level of an impulse turbine is about one-third lower than that of a reaction turbine. As a result, either less noise is produced during operation, or the manufacture can be simplified as compared to a reaction turbine, because less attention needs to be paid to noise-reducing measures and materials. This results in a turbine that is easier and less expensive to manufacture. The same applies to a unit composed of a turbine and a power transmission device combined therewith, because in the case of the transmission, too, the lower speed first of all reduces the generation of noise. Ultimately, for the same mass flow and the same turbine diameter, an impulse turbine delivers twice the power of a reaction turbine having a degree of reaction of 0.5.

The turbine is designed as an axial-inflow impulse turbine. This allows easy fitting into a secondary air channel through which the secondary air stream is drawn in. The turbine housing may be fitted by its round outer contour into an also round section of the secondary air channel, allowing for edgeless, or at least substantially edgeless, transitions between the secondary air channel and the turbine housing and, further, between the turbine housing and the adjoining upstream portion of the secondary air channel. Moreover, unlike with radial-inflow turbines, which require a rectangular or square intake area, the air channel itself may be edgeless because, for example, no transitions are needed between a section of angular cross section for receiving the turbine and an adjoining section which may be configured differently.

If in the turbo-brush, a turbine shaft non-rotatably combined with an impeller of the turbine is surrounded by a shaft housing, in particular a single-piece shaft housing, then the shaft housing acts as a turbulence preventing or reducing guide element for the entering ambient air in the transition region to the impeller, while in the region of the turbine shaft, it serves as a casing for the turbine shaft and to accommodate bearing elements for supporting the turbine shaft. If the shaft housing widens to the full diameter of the impeller in the region of transition to the impeller and has openings allowing flow therethrough to the impeller, then this portion of the shaft housing additionally acts as a guide stage for the impeller. If such a guide stage forms part of the shaft housing, in particular if it is integrally connected to the remainder of the shaft housing, then simple conditions are obtained for the production of the shaft housing and, because of the then possible edgeless transition, favorable conditions are created for a laminar, turbulence-free or low-turbulence flow around the shaft housing, namely, from the casing of the turbine shaft via a guide element that guides the entering ambient air away from the turbine shaft located in the center of the secondary air channel and toward the blades of the impeller, and further to the guide stage.

Through extensive testing, it was found that particularly favorable flow conditions, and thus a particularly good level of efficiency, can be achieved if guide elements provided in the guide stage and stud-like projections on the impeller that act as turbine blades have a specific geometry. Accordingly, provision is made for the guide elements formed in the guide stage to have a cross-sectional outline which is initially curved in a circular arc and then straight, as viewed in the direction of incident flow. The impeller has aerodynamically shaped, stud-like projections uniformly distributed along a circumferential line thereof, the aerodynamic shape having a cross-sectional area which is parabolically bounded on both sides.

Embodiments of the present invention are the subject matter of the dependent claims. The back-references used therein refer to the further development of the subject matter of the main claim by the features of the respective dependent claim. In addition, they may also include independent inventions, whose creation is independent of the subject matters of the preceding claims, and are not to be understood as renouncing attainment of an independent protection of subject matter for the features thereof. Furthermore, with regard to an interpretation of the claims in the case of a more detailed concretization of a feature in a subordinate claim, it is to be assumed that a restriction of said kind is not present in the respective preceding claims.

In a particular embodiment, the vacuum cleaner turbo-brush has a two-stage transmission for driving the brush roller, said transmission being located downstream of the turbine and being designed, in particular, as a belt transmission. The transmission permits a high speed of rotation of the brush roller to be obtained with a lower turbine speed than would be possible using a direct drive for the brush roller. The design-related lower speed of an impulse turbine, as compared to a reaction turbine, can be compensated for, or more than compensated for, by using a two-stage transmission. At the speeds normally encountered during operation, a transmission designed as a belt transmission makes it possible to largely avoid running noise.

In another embodiment, the vacuum cleaner turbo-brush has a transmission housing surrounding the transmission and having a turbine shaft opening and a drive belt opening as well as means for combination with the shaft housing. The transmission housing also encloses the transmission, so that in the secondary air stream, or in the region of the secondary air stream, a significant portion of the moving components are enclosed, except, of course, for the turbine wheel. This prevents or reduces accumulation of dirt on the one hand and swirling of air on the other hand, which would cause turbulence, resulting in reduced turbine efficiency.

In a particular embodiment, the cross-sectional area of the stud-like projections of the impeller is parabolically bounded on both sides in such a way that a wider parabolic arc forms the boundary at a lower side surface and a narrower parabolic arc forms the boundary at an upper side surface, as viewed in the direction of rotation. Such a geometry makes each stud-like projection an aerodynamic surface similar to a wing airfoil, thus improving the efficiency of the turbine.

If in the vacuum cleaner turbo-brush having a housing and a primary and a secondary air channel formed therein, the turbine is disposed in the secondary air channel and the primary air channel is disposed centrally in the housing, and the secondary air channel is disposed laterally adjacent to the primary air channel, then it is ensured that the suction power is concentrated on the primary air channel. Only a portion of the suction power is directed through the secondary air channel in order to draw in ambient air. This provides an optimum of both high suction power through the primary air channel and high turbine power for driving the brush roller.

A housing of the vacuum cleaner turbo-brush may have, first of all, a lower shell and walls of the primary and secondary air channels which walls are connected, in particular integrally connected, to the lower shell and, secondly, an intermediate shell for covering the primary and secondary air channels in the lower shell. Thus, simple conditions are obtained for the structural configuration. The lower shell, or the lower shell and channel walls integrally connected thereto, can be manufactured in one step, for example, as an injection-molded part. The same holds true for the intermediate shell. Once at least the turbine is mounted in the secondary air channel, or in an inflow region of the secondary air channel, the intermediate shell can be combined with the lower shell in a simple assembly step.

In a particular embodiment, the housing of the vacuum cleaner turbo-brush has a cover shell having formed therein at least one air inlet opening, or air inlet openings, for the turbine. By disposing the air inlet openings in the cover shell; i.e., remote from the surface to be vacuumed, it is achieved, firstly, that dirt particles, which could impair the operation of the turbine, are prevented from being drawn in with the secondary air stream and, secondly, that when the vacuum cleaner turbo-brush is lifted from the floor, no disturbing howling occurs as a result of the ensuing abrupt change in flow paths.

If the air inlet openings are formed in the cover shell at both sides of the primary air channel, in particular in a symmetrically distributed pattern, then the main portion of the housing, which is visible during operation, is given an aesthetically pleasing appearance, where the air inlet openings, or a group of air inlet openings, may be integrated into the exterior design of the housing or its cover shell.

An exemplary embodiment of the present invention will be described in more detail below with reference to the drawing. Corresponding objects or elements are identified by the same reference numerals in all figures.

It is understood that neither this nor any other exemplary embodiment should be construed as limiting the scope of the present invention. Rather, within the scope of the present disclosure, numerous changes and modifications are possible, in particular ones which, for example, by combining or altering individual features or method steps described in the general description and in the context of the, or each, exemplary embodiment, as well as the claims, and contained in the drawings, may be inferred by one skilled in the art with regard to achieving the objective, and lead, through combinable features, to a new subject matter or to new method steps or sequences of method steps.

FIG. 1 shows, in a perspective simplified schematic view, a vacuum cleaner turbo-brush generally designated 10 with its housing 12 open. Housing 12 includes a lower shell 14, a cover shell 18, and an intermediate shell 16, which can be seen in the following figures.

A primary air channel 20 and a secondary air channel 22 are formed in housing 12, and more specifically, in the illustrated embodiment, in lower shell 14. A turbine 24 in the form of an axial-inflow impulse turbine is disposed in secondary air channel 22, and thus, in the secondary air stream occurring therein during the operation of vacuum cleaner turbo-brush 10. Located downstream of and driven by turbine 24 is a transmission which, in the embodiment shown, is designed as a two-stage belt transmission 26. Belt transmission 26, in turn, is provided for driving a brush roller 28 of vacuum cleaner turbo-brush 10 in a manner known per se. The drive belt 30 provided therefor is shown in the figure. Belt transmission 26 is actually not visible in this figure, but only a transmission housing surrounding the same. Here and in the following, the transmission and the transmission housing are denoted by the same reference numeral 26. The transmission housing has a drive belt opening for exit of drive belt 30 and a turbine shaft opening for combination with turbine 24.

Primary air channel 20 is disposed centrally in housing 12. Secondary air channel 22 is located laterally adjacent to primary air channel 20. Primary and secondary air channels 20, 22 open into a wand connector 32 with which, for example, a vacuum cleaner hose (suction wand) may be combined in a generally known manner, so that the suction air stream generated by the vacuum cleaner fan produces a primary air stream through primary air channel 20 and a secondary air stream through secondary air channel 22. Primary and secondary air channels 20, 22 are formed by walls 34 which are formed in, or combinable with, lower shell 14.

FIG. 2 shows further details of turbine 24, which are not described or mentioned in connection with FIG. 1 for the sake of clarity. Turbine 24 is shown in a perspective, partially cut-away view. Turbine 24 is an axial-inflow impulse turbine, in short just called turbine 24 hereinafter. The turbine includes a turbine housing 36, an impeller 38, and a turbine shaft 40 non-rotatably connected to impeller 38. Turbine shaft 40 is surrounded by a bearing housing 42, which, at the end facing impeller 38, widens in an edgeless manner, starting from a portion in the region of the shaft, thus forming a transition 44. Bearing elements 46 are disposed inside bearing housing 42, so that turbine shaft 40 and bearing elements 46 are protected from contamination during operation. This also facilitates the mounting of turbine 24 in lower shell 14 (FIG. 1) of housing 12. Such mounting may in particular be limited to inserting turbine 24 by its turbine housing 36 into a recess which is formed for this purpose in lower shell 14 in secondary air channel 22 and fixes turbine 24 in the direction of flow. Once intermediate shell 16 (FIG. 5) is mounted, turbine 24 is entirely locked in position in secondary air channel 22.

At the end opposite impeller 38, bearing housing 42 has means for combination with a housing of transmission 26. Specifically, in the embodiment shown, said combination means is constituted by a sealing area 48. At the end facing transmission 26, turbine shaft 40 terminates in a belt pulley 50. Here, the housing surrounding transmission 26 has a turbine shaft opening into which belt pulley 50 extends. The transmission housing further has means for combination with bearing housing 42, such as, for example, a seal which, together with sealing area 48 of bearing housing 42, seals the turbine shaft opening, and particularly in a dust-tight manner.

Figure 3:
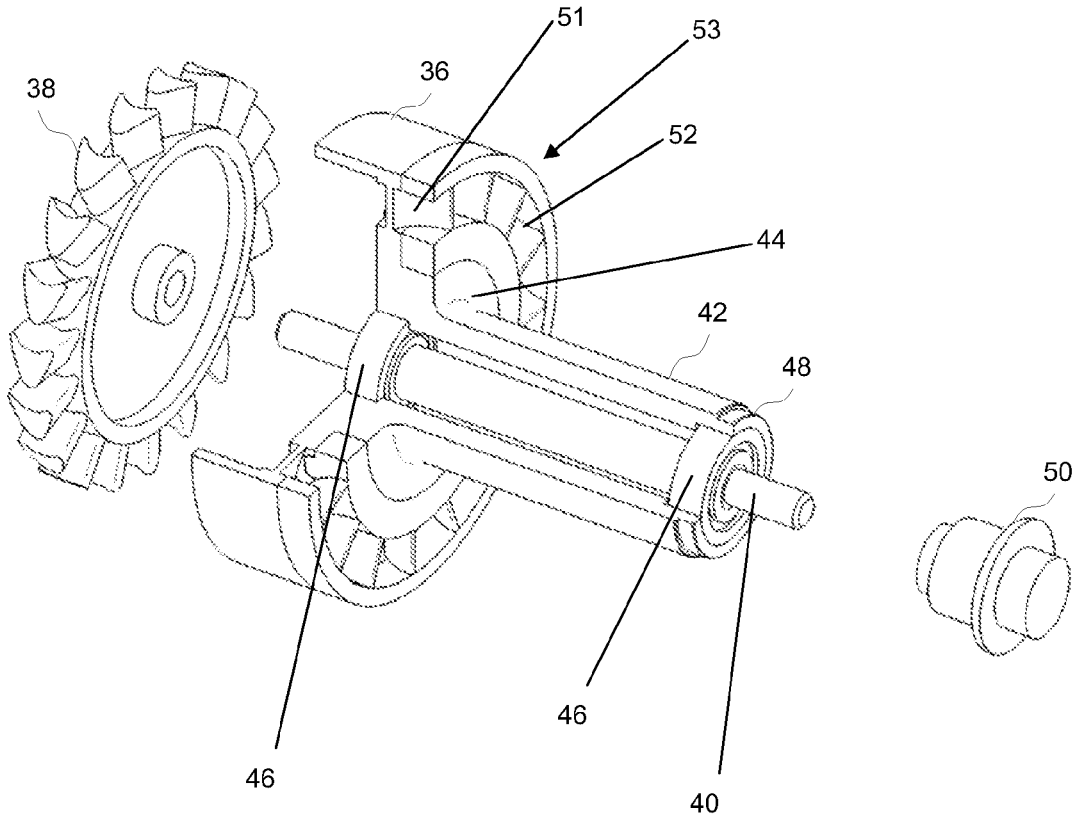
FIG. 3 is an exploded view of the turbine of FIG. 2.

At the end facing impeller 38, turbine housing 36 is integrally formed, or detachably combined, with bearing housing 42 through a first part 51 of a guide stage in a region behind transition 44. A second part 52 of guide stage 53 is superimposed on transition 44. Guide stage 53 and impeller 38 will be explained in more detail with reference to FIG. 4, but before, FIG. 3 shows a partially cut-away exploded view of the turbine according to FIG. 2.

FIG. 4 shows, in schematic simplified form, a detail of a tangential section through impeller 38 and guide stage 53. The upward pointing block arrow indicates the direction of the incident flow of ambient air/secondary air occurring during operation. As can be seen, the guide stage has a plurality of guide surfaces 54, and the impeller has a plurality of stud-like projections 56 acting as turbine blades. As can be seen more clearly in FIG. 2 and FIG. 3, stud-like projections 56 and guide surfaces 54 are uniformly distributed around the circumference of impeller 38 and guide stage 53, respectively. The geometry of guide surfaces 54 is such that they direct the incident flow of ambient air initially in a circular arc path and then in a straight path to impeller 38. Stud-like projections 56 are aerodynamically shaped, the aerodynamic shape having a cross-sectional area which is parabolically bounded on both sides. In the embodiment shown, the cross-sectional area of each stud-like projection 56, which is parabolically bounded on both sides, is bounded by an upper side surface 58 and an adjoining lower side surface 60, as viewed in the direction of rotation (indicated by the simple arrow pointing to the right). Upper side surface 58 forms a first parabolic arc. Lower side surface 60 forms a second parabolic arc which has a different shape as compared to the first parabolic arc, the first parabolic arc being narrower than the second parabolic arc. In other words, the lower, second parabolic arc is wider than the upper, first parabolic arc. This geometry makes it possible to achieve a cross-sectional area for stud-like projections 56 which gives them an altogether aerodynamically active geometry similar to a wing airfoil.

Figure 5:
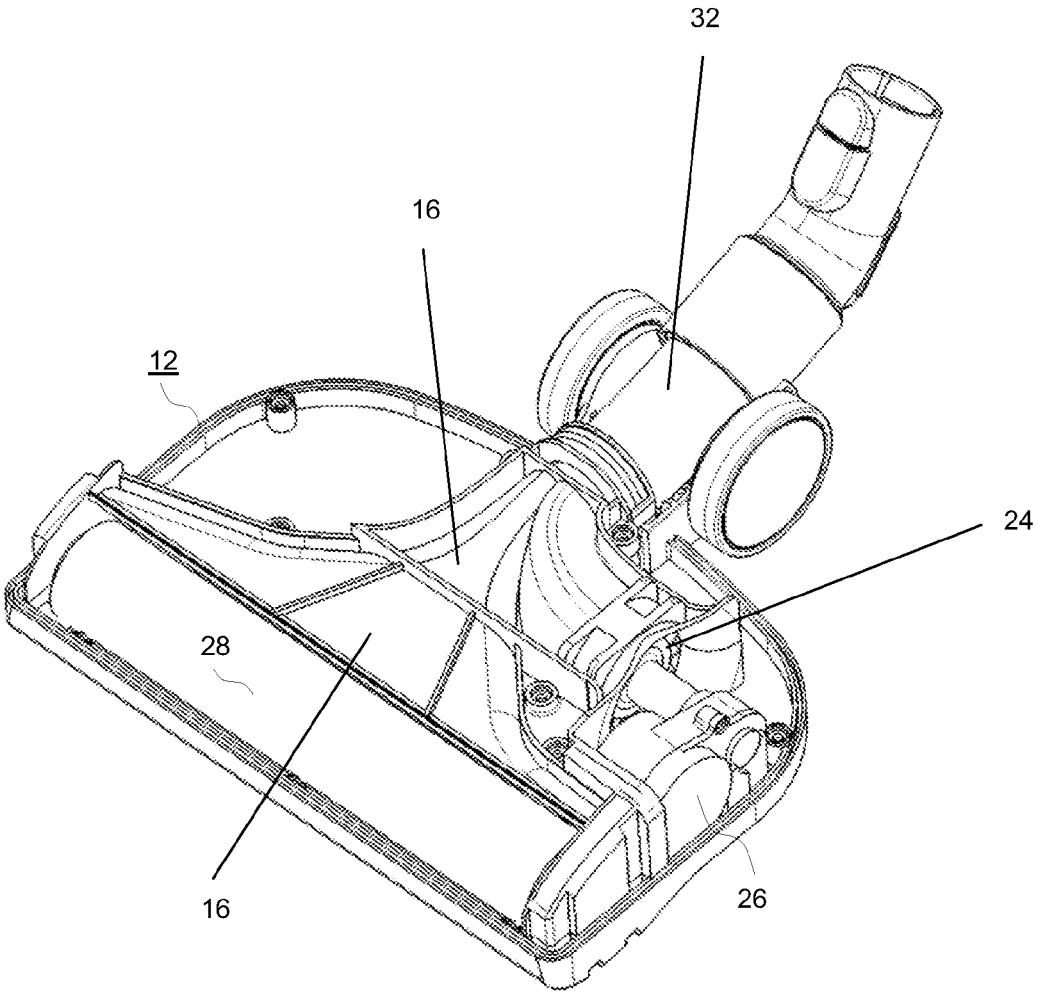
FIG. 5 is a view showing the vacuum cleaner turbo-brush of FIG. 1 with the intermediate shell mounted in the housing.

FIG. 5 shows vacuum cleaner turbo-brush of FIG. 1 from the same perspective. In contrast to the situation depicted in FIG. 1, intermediate shell 16 is now mounted in lower shell 14. The intermediate shell, in conjunction with walls 34 (not shown in FIG. 5, see FIG. 1), closes primary and secondary air channels 20, 22 (not shown in FIG. 5; see FIG. 1) at the top. Further, it can be seen that drive belt 30 (not shown in FIG. 5; see FIG. 1) is protected by a cover combined with the transmission housing. When turbine 24 is in the shown, mounted position in secondary air channel 22, the only visible parts of it are its guide stage 53 (FIG. 2) and turbine shaft 40. Further, it can be seen that secondary air channel 22, as formed by its walls in conjunction with intermediate shell 16, widens in the manner of a funnel, thus forming an inflow region for turbine 24. Secondary air channel 22 is coupled to the interior volume of housing 12 with the aid of intermediate shell 16, so that ambient air flowing into housing 12 is drawn in as secondary air.

Figure 6:
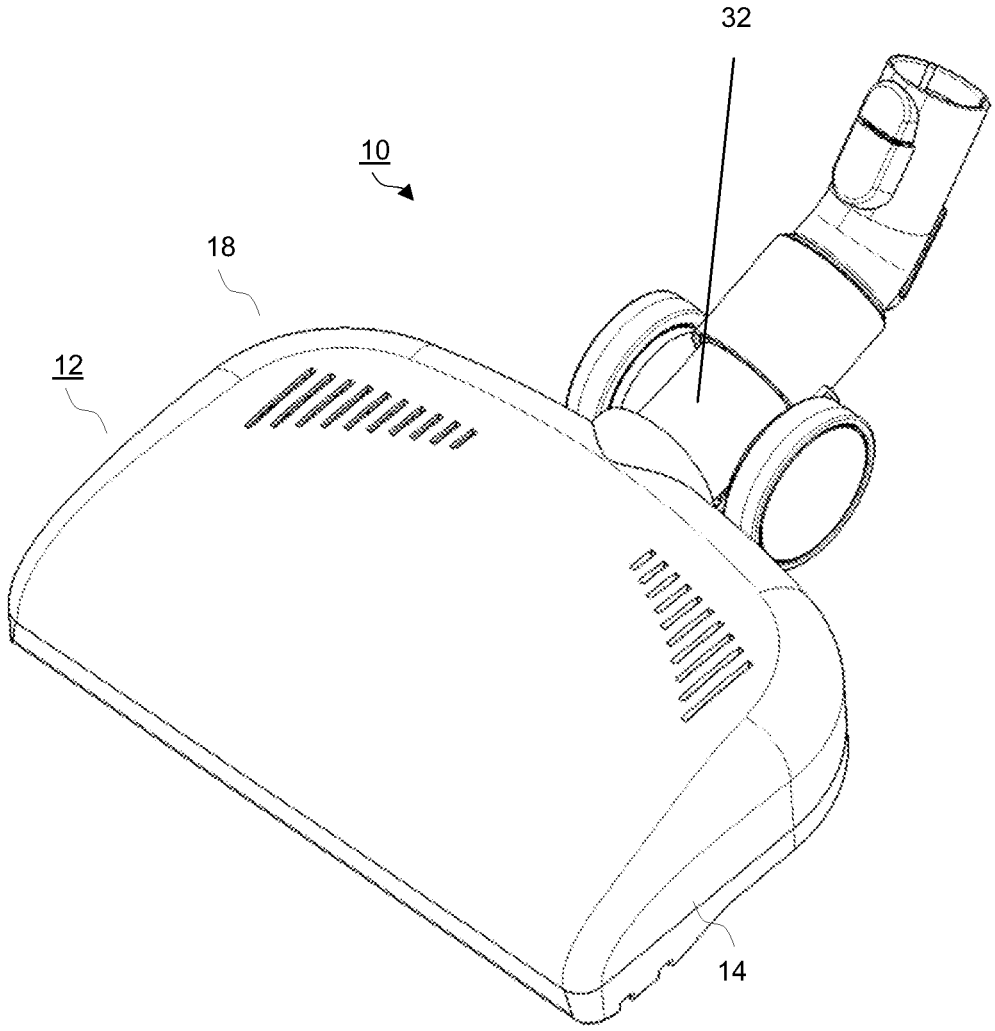
FIG. 6 is a view showing the vacuum cleaner turbo-brush of FIG. 1 with the housing closed.

Finally, FIG. 6 shows a vacuum cleaner turbo-brush 10 with housing 12 closed by an attached cover shell 18. Cover shell 18 has formed therein air inlet openings 62, here in the form of two symmetrically arranged groups of air inlet openings 62. Ambient air passes enters the interior of housing 12 through the air inlet openings. As already mentioned above, secondary air channel 22 is coupled to the interior volume of housing 12, so that when the vacuum cleaner fan is energized and produces a suction air stream, ambient air is drawn in through air inlet openings 62 for the secondary air stream.

Thus, embodiments of the present invention provide a turbo-brush for a vacuum cleaner, which has a turbine 24 for driving a brush roller 28, which turbine 24 is disposed in a secondary air channel 22, and thus, in a secondary air stream during operation, and is designed as an impulse turbine, in particular as an axial-inflow impulse turbine. Overall, the present invention and embodiments thereof also relate to a vacuum cleaner having such a turbo-brush.

While the invention has been particularly shown and described with reference to preferred embodiments thereof, it will be understood by those skilled in the art that various changes in form and details may be made therein without departing from the spirit and scope of the invention.

What is claimed is:

1. A vacuum cleaner turbo-brush comprising:

an axial-inflow impulse turbine disposed in a secondary airstream area of the vacuum cleaner and including:

a turbine shaft non-rotatably combined with an impeller, the impeller including aerodynamically shaped, stud-like projections uniformly distributed along a circumferential line of the impeller, the aerodynamic shape having a cross-sectional area that is parabolically bound on both sides;

a guide stage including guide surfaces, each guide surface having a cross section including, in a direction of incident flow, a circular arc followed by a straight section; and a bearing housing surrounding the turbine shaft, the bearing housing forming at least one of a transition and the guide stage in a region of the impeller, and the bearing housing, in a region of the turbine shaft, providing a casing for the turbine shaft and including bearing elements that support the turbine shaft.

2. The vacuum cleaner turbo-brush recited in claim 1, further comprising a two-stage belt transmission disposed downstream of the turbine.

3. The vacuum cleaner turbo-brush recited in claim 2, further comprising a transmission housing surrounding the two-stage belt transmission, the transmission housing including a turbine shaft opening and a drive belt opening and a connection with the bearing housing.

4. The vacuum cleaner turbo-brush recited in claim 3, wherein the cross-sectional area of the stud-like projections of the impeller, with respect to a direction of rotation, includes a lower side surface having a first parabolic arc and an upper side surface including a second parabolic arc, the first parabolic arc being wider than the second parabolic arc.

5. The vacuum cleaner turbo-brush recited in claim 1, further comprising a housing forming a primary air channel and a secondary air channel with the turbine disposed therein, the primary air channel being disposed centrally in the housing and the secondary air channel being disposed laterally adjacent to the primary air channel.

6. The vacuum cleaner turbo-brush recited in claim 2, further comprising a housing forming a primary air channel and a secondary air channel with the turbine disposed therein, the primary air channel being disposed centrally in the housing and the secondary air channel being disposed laterally adjacent to the primary air channel.

7. The vacuum cleaner turbo-brush recited in claim 3, further comprising a housing forming a primary air channel and a secondary air channel with the turbine disposed therein, the primary air channel being disposed centrally in the housing and the secondary air channel being disposed laterally adjacent to the primary air channel.

8. The vacuum cleaner turbo-brush recited in claim 4, further comprising a housing forming a primary air channel and a secondary air channel with the turbine disposed therein, the primary air channel being disposed centrally in the housing and the secondary air channel being disposed laterally adjacent to the primary air channel.

9. The vacuum cleaner turbo-brush recited in claim 5, wherein the housing includes a lower shell, walls of the primary and secondary air channels connected to the lower shell, and an intermediate shell covering the primary and secondary air channels.

10. The vacuum cleaner turbo-brush recited in claim 5, wherein the housing includes a cover shell including air inlet openings associated with the turbine.

11. The vacuum cleaner turbo-brush recited in claim 9, wherein the housing includes a cover shell including air inlet openings associated with the turbine.

12. The vacuum cleaner turbo-brush recited in claim 5, wherein the housing includes a cover shell including air inlet openings disposed on both sides of the primary air channel.

13. The vacuum cleaner turbo-brush recited in claim 9, wherein the housing includes a cover shell including air inlet openings disposed on both sides of the primary air channel.

14. The vacuum cleaner turbo-brush recited in claim 10, wherein the air inlet openings are disposed on both sides of the primary air channel.

* * * * *